United States Patent [19]

Nunan

[11] 4,200,844

[45] Apr. 29, 1980

[54] RACETRACK MICROTRON BEAM EXTRACTION SYSTEM

[75] Inventor: Craig S. Nunan, Los Altos Hills, Calif.

[73] Assignee: Varian Associates, Palo Alto, Calif.

[21] Appl. No.: 948,842

[22] Filed: Oct. 5, 1978

Related U.S. Application Data

[63] Continuation of Ser. No. 750,106, Dec. 13, 1976, abandoned.

[51] Int. Cl.[2] ..... H05H 7/10; H05H 13/00

[52] U.S. Cl. ..... 328/230; 313/62; 313/160; 328/234

[58] Field of Search ..... 313/62, 160; 328/234, 328/230

[56] References Cited

U.S. PATENT DOCUMENTS

| | | | |
|---|---|---|---|
| 2,626,351 | 1/1953 | Powell | 328/230 X |
| 3,546,524 | 12/1970 | Stark | 328/233 X |

FOREIGN PATENT DOCUMENTS

| | | | |
|---|---|---|---|
| 775275 | 1/1968 | Canada | 328/234 |

OTHER PUBLICATIONS

"A Design Study of a 100 MeV Racetrack Microtron/-Pulse-Stretcher Accelerator System," by R. Alvinsson and M. Eriksson, Division of Electron Physics, Royal Institute of Technology, Stockholm, Sweden, Apr. 1976, pp. 5, 6, 7, 28, 29, 30, 49, 22, 12.

*Primary Examiner*—Palmer C. Demeo

*Attorney, Agent, or Firm*—Stanley Z. Cole; Edward H. Berkowitz

[57] ABSTRACT

Beam extraction from a selectable orbit of a race track microtron is achieved using small angle magnetic deflections toward the common axis of acceleration. The extracted beam and the non-recirculated beam are adapted to occupy congruent final trajectories whereby the non-recirculated beam is available on the same axis as the selectably extracted beam.

16 Claims, 7 Drawing Figures

RACETRACK MICROTRON BEAM EXTRACTION SYSTEM

This is a continuation of application Ser. No. 750,106, Filed Dec. 13, 1976, and now abandoned.

BACKGROUND OF THE INVENTION

This invention is in the art of charged particle accelerators and particularly applies to beam extraction from a racetrack microtron.

DESCRIPTION OF PRIOR ART

Heretofore the recirculation of a beam of charged particles through a linear accelerator has been effected with the aid of bending magnets which direct the accelerated beam in a path external to the accelerator waveguide for reinjection at the low energy end thereof. Such a structure is disclosed, for example, in "Performance of a Multicavity Racetrack Microtron", H. R. Froelich and J. J. Manca, IEEE Transactions on Nuclear Science Vol NS-22, No. 3, June 1975. The particle trajectory ordinarily consists of a linear acceleration segment followed by a first 180° (semi-circular) trajectory, a linear drift space equal in length and antiparallel to the acceleration segment, and finally another 180°, or reinjection trajectory from which the beam exits, again colinear with its original path through the acceleration section. The shape of the closed particle trajectory thus suggests the name "racetrack" given to the apparatus. Successive passages through the accelerator wave guide result in corresponding increments of energy added to the beam. The energy gained per orbit, the RF period, the orbital period, the magnetic field intensity and linear dimensions are mutually determined by a resonance condition, well known in microtron design. Due to incremental increase in beam energy for successive orbits, such orbits are characterized by successively greater radii of curvature under the influence of a transverse magnetic field. Ultimately, the beam must be extracted from the apparatus and directed to a target.

Prior art microtrons commonly achieve extraction of the beam from a fixed final orbit by utilization of an unpaired 180° deflection. This is accomplished by employing a 180° deflecting magnet at the output of the accelerating guide accomodating one orbit more than the re-injection magnet. After its final passage through the accelerating guide and first 180° deflection magnet, the accelerated beam is permitted to propagate rectilinearly past the smaller re-injection magnet.

SUMMARY OF THE PRESENT INVENTION

The object of the present invention is to provide an improved racetrack microtron.

In one feature of the invention provision is made for beam extraction from a selectable orbit.

In another feature of the present invention, extraction is accomplished in at least two small angle inward deflection with an intermediate deflection of $180°-\alpha$, where $\alpha$ is substantially the sum of said small angles.

In another feature of the invention, compensatory means are provided at the exit of the reinjection magnet for compensating the defocusing effects of such magnet in the plane orthogonal to the bending plane where such defocusing is occasioned by the small angle deviation from normal incidence at the entrance and exit of said reinjection magnet.

In another feature of the invention additional magnetic deflection and compensating focusing is provided to place the extracted beam and the non-recirculated beam on a common axis.

In still another feature of the invention, a dual gap magnet, to provide the initial extraction deflection, is disposed on the outside of a thin planar vacuum chamber containing the microtron beam, said dual gap magnet being adapted to move along the surface of said chamber.

In yet another feature of the invention the initial extraction from a selected orbit is accomplished by exciting appropriate coils in a stationary multi-gap magnet, each gap of which corresponds to a distinct orbit of said microtron beam.

In again another feature of the invention the planar vacuum chamber containing the microtron beam is provided with arcuate and linear inserts defining the geometry of the orbits and providing additional structural integrity for the vacuum chamber.

DESCRIPTION OF THE PREFERRED EMBODIMENTS

Figure 1:
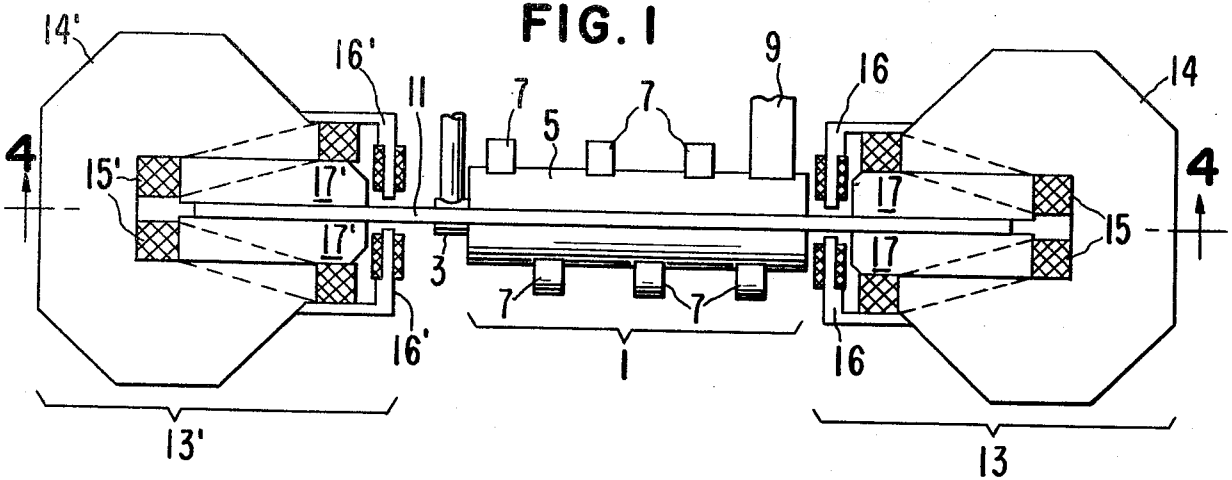
FIG. 1 is a schematic top view of the preferred embodiment

Referring now to FIG. 1, several major components of a racetrack microtron are illustrated in the plane transverse to the plane of beam orbits. A linear accelerator (linac) 1 comprises a charged particle injector 3 from which a low energy beam is projected along the axis of a multi-cavity linear accelerator wave guide 5. The injector 3 may take the annular coaxial form of FIG. 1. The linac preferably comprises side cavities 7 to couple microwave energy between acceleration cavities 8 (see FIG. 4) internal to accelerator guide 5. The linac is energized with microwave energy from microwave feed 9. A thin planar vacuum envelope 11 geometrically situate in the midplane of the accelerator guide 5 communicates with the injection to, and high energy exit from the accelerator guide. Two 180° magnets 13 and 13' cooperate to deflect the accelerator beam in such manner as to place the previously accelerated beam again on the axis of the accelerator wave guide as discussed below. Each of these magnets 13 and 13' comprises yokes 14 and 14', excitation coils 15 and 15', pole pieces 17 and 17', and focussing trim magnets 16 and 16'. Magnets 16 and 16' each function to compensate for defocusing in the plane transverse to the orbital plane, this effect being due to the fringing fields of corresponding pole pieces 17 and 17'.

An alternative for injection, not illustrated herein, would employ an electron gun disposed off axis together with an injection magnet for deflecting the injected beam onto the accelerator axis. Such an approach requires passage of the recirculated beam through a portion of the field of the injection magnet; consequently correction elements are required for the recirculated beam to maintain desired geometric and phase space properties for further acceleration.

Figure 2:
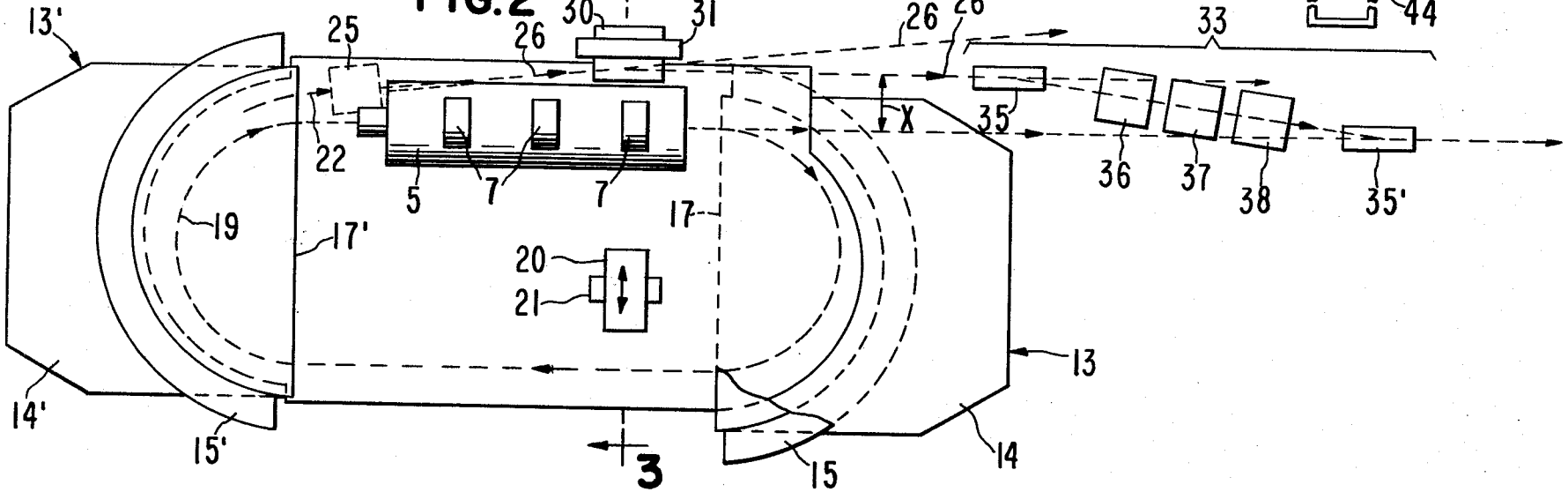
FIG. 2 is a side view of the apparatus of FIG. 1.

Turning now to FIG. 2 there is shown the apparatus of FIG. 1 showing the plane of the beam orbits and additional beam manipulative equipment to be described. Semicircular pole pieces 17 and 17' of the respective 180° magnets are shown with typical beam orbital portion 19. It should be understood that each of the pole pieces 17 and 17' is made up of two spaced parallel plates, one behind the other as viewed in FIG. 2. Extraction of the beam from a selected orbit is initiated by the field of a movable magnet 20 the operation of which will be described below. Movable extraction magnet 20 cooperates with the 180 magnet 13', hereafter the reinjection magnet, to produce an extracted beam 22 which passes through focus compensation means, for example, quadrupole singlet 25. The defocusing here compensated arises from the small angle of incidence of the selected orbit beam to the field of magnet 13'. The extracted beam 26 is then available for use. Alternatively, the beam undergoes a second small angle deflection in a fixed extraction magnet 30 excited by coils 31 to produce an inward deflection equal to that produced by movable magnet 20. The resulting beam 26' is rendered parallel to the axis of the accelerated wave guide but displaced therefrom by an amount x, as shown in FIG. 2. A translation system 33 comprising bending magnet 35, a quadrupole triplet 36–38 and another bending magnet 35' serve to place the extracted beam colinear with the accelerator wave guide axis. As a result, the direct output from the linear accelerator may be selected merely by non-excitation of the field of the magnets 13 and 35'. Alternatively, the original beam through the accelerator can be translated outwardly to be coaxial with the path of the higher energy beam 26 emerging from quadrupole singlet 25, or beam 26' from fixed extraction magnet 30. The preferred embodiment accommodates 10 orbits from which any of the orbits $N=2, \ldots 10$ may be selected for extraction by the above described apparatus and for which the direct output ($N=1$) is also available.

Figure 4:
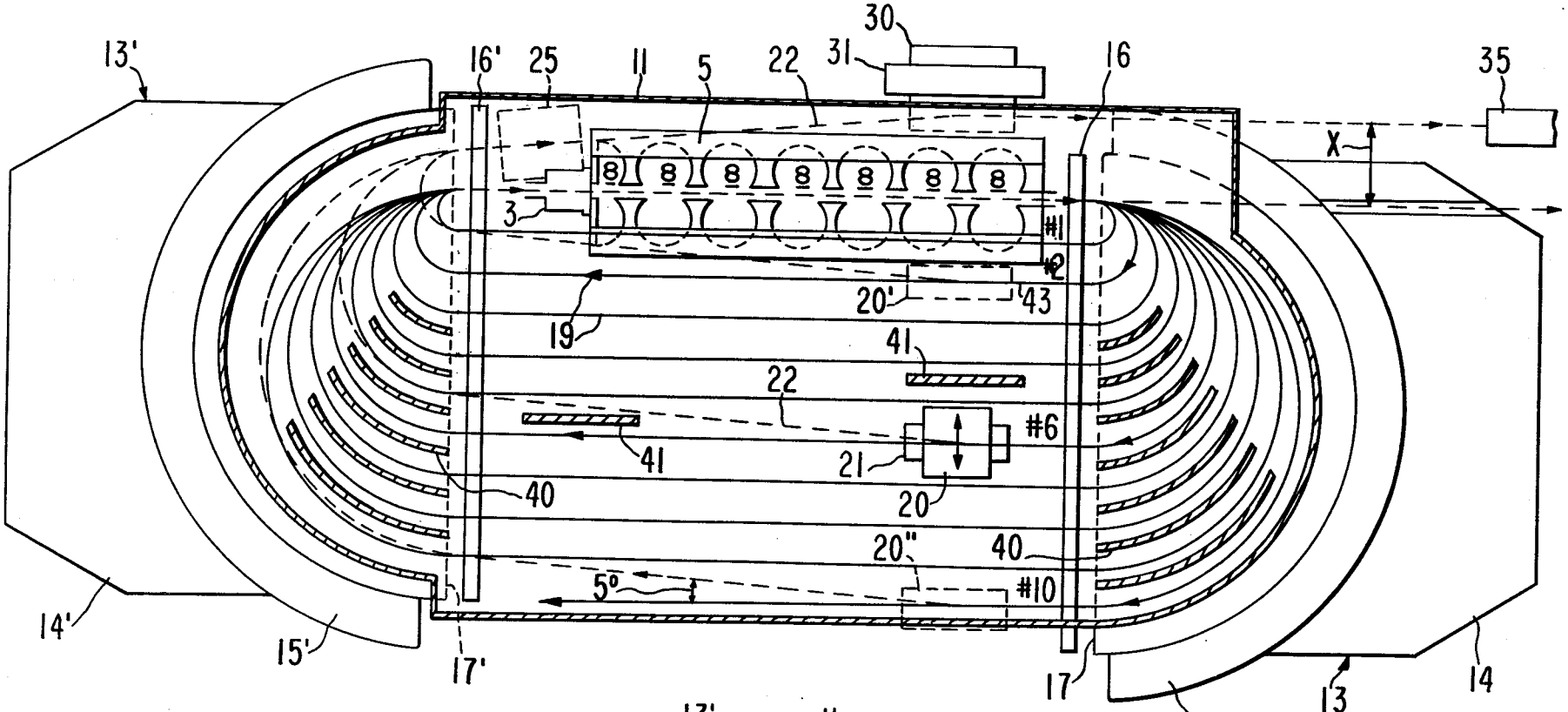
FIG. 4 is a cross sectional view of FIG. 1 taken on line 4—4.

The extraction system is best understood by now considering FIG. 4. Within vacuum chamber 11, a charged particle injector 3, as for example an annular emitting electron gun injects a beam of electrons of energy E along the axis of linear accelerator wave guide 5. Microwave energy is coupled to the beam in its passage through accelerator cavities 8. A suitable linac waveguide is described in greater detail in U.S. Pat. No. 3,546,524. The accelerated beam acquires an increment of energy $E_o$, for example 4 MeV, from the accelerator wave guide 5 and enters the magnetic field of the first 180° magnet 13, the structure of which has been previously described. The beam then drifts a distance very nearly equal to the length through the accelerator segment whereupon it undergoes another 180° deflection under the influence of the reinjection magnet 13'. The result of the last 180° deflection is to position the beam on the axis of the accelerator waveguide 5 for another orbit of the microtron. Each orbit increases the energy of the beam with an attendant increase in the radius of curvature of the beam in the magnetic field of each of the 180° deflection magnets. Arcuate inserts 40 geometrically define the orbits and thereby reduce low energy tails in the momentum distribution of the beam. These inserts also lend support and structural integrity to the vacuum envelope 11. A similar function is accorded inserts 41, a representative pair of which are shown.

Figure 3:
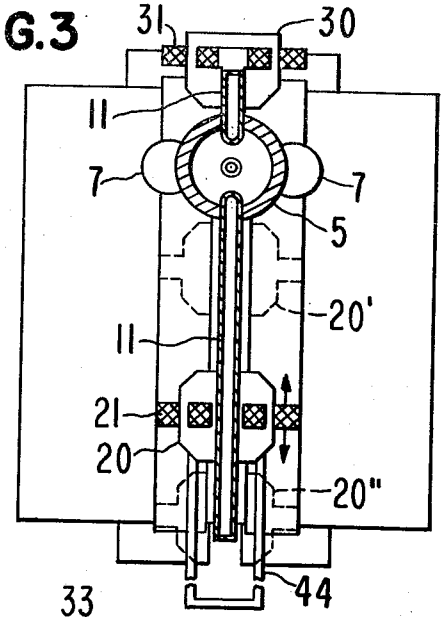
FIG. 3 is a cross sectional view of a portion of the structure of FIG. 2 delineated by section 3—3.

The movable dual gap extraction magnet 20, slideably mounted on the outside of vacuum chamber 11, can be translated across the field free drift space transverse to the beam orbits from an extreme inward position 20' corresponding to second lowest energy orbit 43 to extreme outward position 20'' corresponding to the outermost (highest energy) orbit. The very lowest energy orbit passes through a tube in the wall of the accelerator waveguide in the compact preferred embodiment, so the magnet 20 is not movable to a position for interaction with this first orbit. The structure and arrangement of the movable dual gap extraction magnet 20 can be more easily understood with reference to FIG. 3, a section of FIG. 2 primarily through the plane of motion of the movable magnet 20. The portions of magnet 20 disposed or opposite external surfaces of envelope 11 are maintained in mutual alignment by arms 44. The excitation of magnet 20 is provided by coils 21. Returning now to FIG. 4, the field of magnet 20 is adjusted to provide a field sufficient to cause a deflection of the beam of the selected Nth orbit to enter the field of the reinjection magnet 13' at a small angle with respect to normal incidence, for example 5, and at substantially the position of orbit $N-1$. It will be observed that the diameter of the acceleration wave guide the energy increment E added by the wave guide, as well as other parameters, determine the extreme inward position which can accomodate the extraction magnet 20.

The path of the beam in the reinjection magnet 13' is characterized by a radius of curvature appropriate to the energy of the Nth orbit or E; $+(N \times E_o)$, where E; is the initial energy of the beam injected from injector 3. However the extracted Nth orbit enters the re-injection field at the position of the $N-1$ orbit of energy E; $+[(N-1) \times E_o]$. The greater radius of curvature of the higher energy beam results in a path which cannot achieve colinearity with the acceleration axis, but instead crosses the acceleration axis with a substantial component projected parallel to said axis. The net deflection in the reinjection magnet is, for example, 170°, and the emerging beam is directed at 5° with respect to the acceleration axis.

Figure 5:
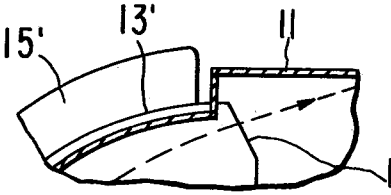
FIG. 5 is a detail of a portion of the reinjection magnet pole piece.

In the course of the 170° deflection, the extracted beam experiences a net defocusing in the plane normal to the plane of deflection due to non-normal direction of incidence and exit of the beam from the re-injection field and the field of the trim magnet 16'. Accordingly, compensating focusing is provided by magnetic quadrupole singlet 25. Alternatively, as in FIG. 5, the pole face 13' may be shaped as shown altering the lateral surface 13'' adjacent the exit portion of the trajectory to compensate this defocusing effect. In following this alternative, quadrupole 25 may be deleted from the system.

Figure 6:
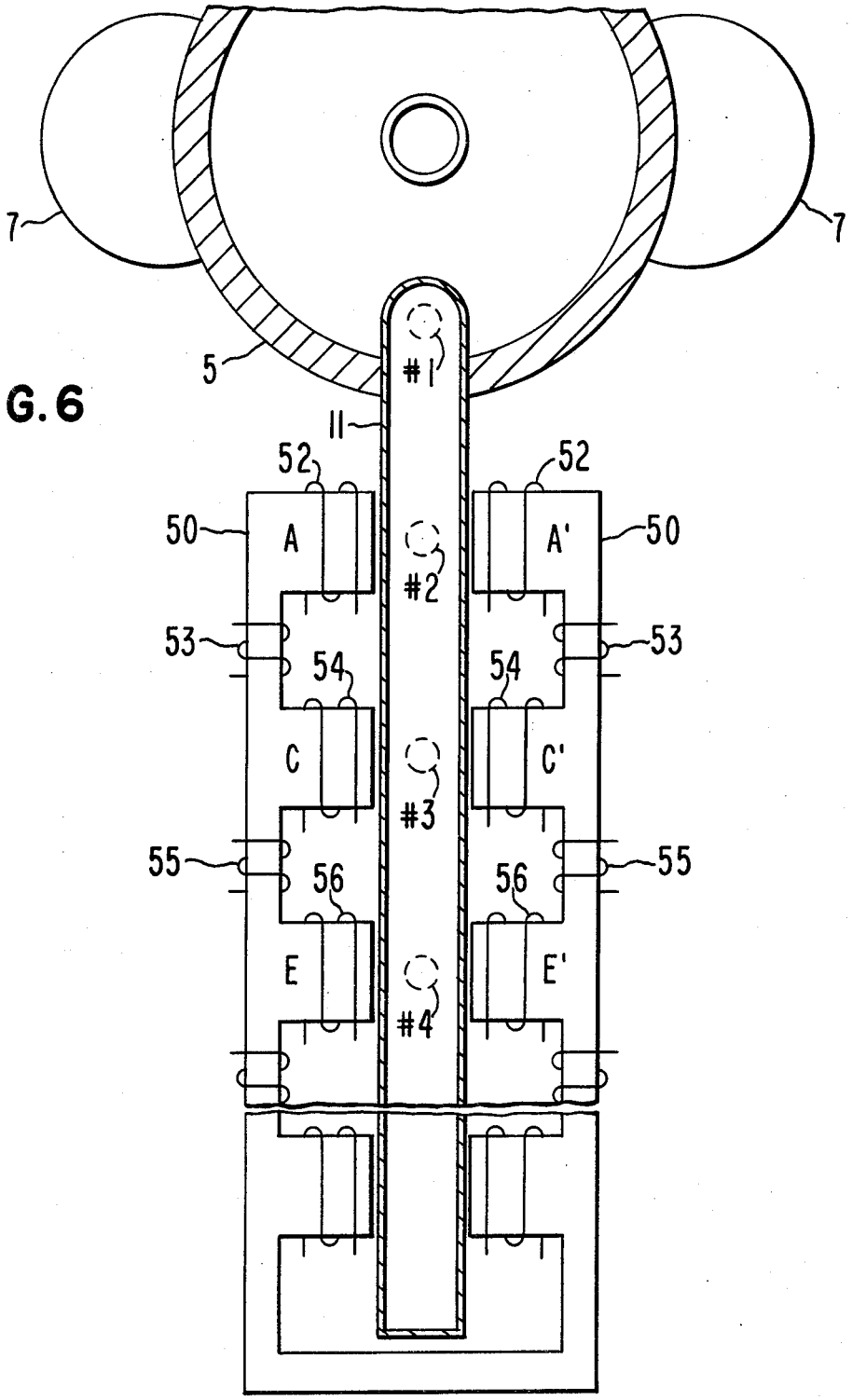
FIG. 6 illustrates a stationary multi-gap first extraction magnet.

FIG. 6 illustrates an embodiment for an alternative to the movable extraction magnet. A multi-gap stationary magnet comprises a yoke 50, and a number of pairs of pole pieces A–A', C–C', E–E', etc., each positioned to act on a given orbit. Each gap has associated coils, for example, 52, 54, 56 for excitation of its pole pieces. The selected gap is excited by its respective coils and poles for inwardly deflecting the beam 5° from the orbit selected for extraction; the magnetic field in the gap for the next higher orbital position is likewise excited, however in the opposite sense in order to provide an efficient return flux path. Inhibiting coils, for example 53 or 55, are excited to isolate the flux from influencing prior orbits, as for example when extracting the beam from orbits #3 or #4, respectively. Thus this embodiment achieves selected extraction from any one of a number of orbits without the necessity of moving parts. Assume, for example, that it is desired to extract the beam from orbit #3. Coils 54 are energized to excite the field required for the 5° inward deflection of the 3rd orbit traversing gap C–C'. Coils 56 are excited to produce a magnetic field in the opposite direction across gap E—E' thereby completing the magnetic circuit. Inhibit coils 53 are energized to cancel flux in the yoke which might cross gap A–A', thereby influencing prior orbit #2. In the design illustrated herein, orbit #1 is inaccessible to the extraction method of the present invention.

Figure 7:
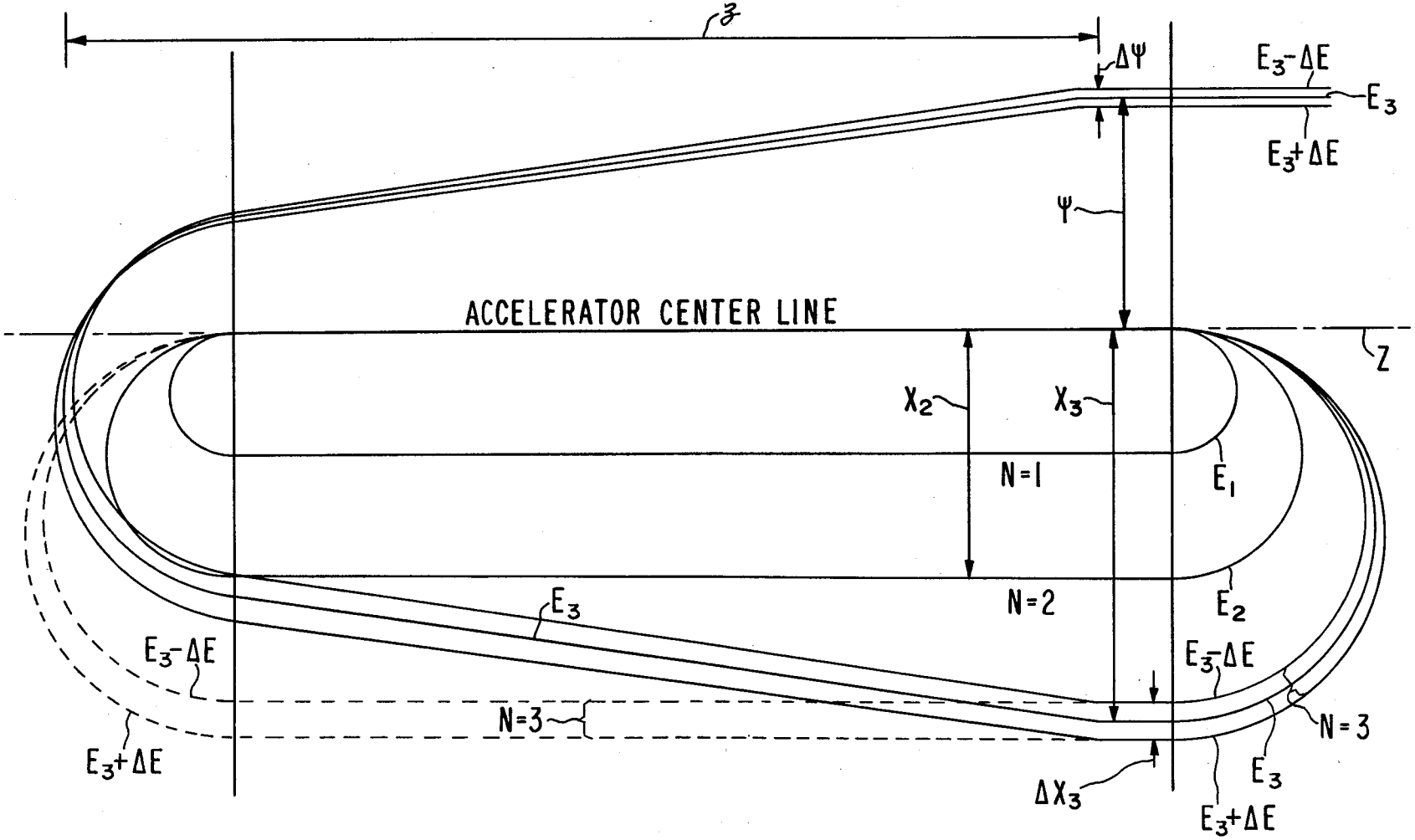
FIG. 7 is a schematic view of trajectories for extraction from orbit #3.

The present invention improves the attainable spatial energy dispersion of the extracted beam as may be demonstrated with the aid of FIG. 7. FIG. 7 provides a plan of the orbital paths of interest for the specific choice of extraction from orbit N=3, the selected orbit having a hypothetical energy spread $\Delta E/E_3=10\%$ and $E_3$ represents the hypothetical central energy of orbit N=3. Deviant energy trajectories corresponding to energies $E_3\pm\Delta E$ are also shown. It will be observed that after a first 180° deflection following acceleration, the displacement of the beam outward from the acceleration axis is proportional to the energy of the beam particles and therefore to the orbit number. The second 180° deflection, independent of orbit number, results in placing the reinjected beam on the acceleration axis. Consequently, orbits N=2 . . . 10, although differing by one unit of orbital energy gain, are returned to a common axis for acceleration. Consider now a particle of a given relative deviation in energy $\Delta E$ from the nominal energy $E_3=NE_0+E_i$ for the choice N=3. The injection energy $E_i$ will now be ignored for convenience. This deviation $\Delta E$ results in concomitant spatial displacement of the energy deviated trajectory from the central orbit N=3. Extraction from this orbit results in substantially parallel paths for the envelope of the 3rd orbit beam of energies $E_3\pm\Delta E$. Where this orbit is not selected for extraction (dotted lines), it will be apparent that the displacement of the deviant path is compensated by the second 180° deflection in like manner as the different orbits are again reinjected on the acceleration axis independent of orbit number N. For any extractable orbit (N=2, . . . 10) the common central orbit for the beam of energy $E_N$, after passage through the pole pieces 30 of the stationary extraction magnet, is substantially parallel to, and displaced from the acceleration axis by an amount $\psi$ independent of N.

In the specific instance shown in FIG. 7 the extracted beam of orbit #3 including central trajectory of energy E and deviant energy $E_3\pm\Delta E$ emerge from the first 180° deflection in parallel paths displaced respectively $X_3$and $X_3\pm\Delta X_3$ from the accelerator axis. An inward magnetic deflection such as by magnet 20 directs these rays toward the accelerator axis entering the field of the re-injection magnet at a displacement corresponding roughly to $X_2$ from the accelerator axis. Due to the difference in energy these paths now depart slightly from parallelism as they exit the re-injection magnet due to dispersion introduced by the inward magnetic deflection. These trajectories are deflected by the reinjection magnet through an angle less than 180° by an amount twice the initial extraction angle $\theta$. The angle $\theta$ is measured with respect to the undeflected path and the factor of two arises from the symmetric treatment of the trajectory by the reinjection magnet. The trajectories of energy $E_3$ and $E_3\pm\Delta E$ are now displaced an amount $\psi$ and $\psi\mp\Delta\psi$ respectively where $\psi$ depends upon the distance along the z axis (accelerator axis) at which the displacement is measured. For relativistic electrons of the present invention, the spatial dispersion $\Delta\psi$ is given to first order in N by $$\Delta\psi=(1/N-1)(\Delta X_N)\ f(z,e)$$

where $$\Delta X_N=\Delta E/E_N\cdot X_N$$

and f $(z,\theta)$ is a function depending upon the distance along the accelerator axis and upon the angle of the extracted trajectory with respect to the accelerator axis. Thus extracted beam dispersion decreases for increasing orbit number. $\Delta E_N$ and $\Delta X_N$ remain relatively constant with increasing orbit number in a racetrack microtron due to the finite range of rf phase angles within which stable acceleration is achieved. Thus, $\Delta X$ decreases with increasing orbit number using the extraction system proposed herein.

As shown by FIG. 7, there is a clear reduction in spatial dispersion between the extracted beam of the present invention and an extraction scheme which would merely extrapolate the straight portion of the path indicated by dotted lines for the extracted orbit (those shown for N=3).

The advantages of the racetrack microtron of the present invention include: orbit selection thereby providing selectable beam energy for extraction, including selection of non-recirculated beam; improved spatial energy dispersion in the extracted beam, and a compact acceleration system well adapted to gantry mounting for therapeutic purposes.

It will be apparent that the principles of the present invention are applicable to apparatus for acceleration of positive ions as well as electrons and that other modifications and embodiments are possible within the scope of this invention. Accordingly, the foregoing is to be construed as descriptive and limited only by the scope of the appended claims.

What is claimed is:

1. A racetrack microtron comprising:

linear accelerator means for producing an energetic beam of charged particles, beam re-circulation means for again introducing said accelerated charged particle beam to said linear accelerator means for further acceleration, said recirculation means defining a plurality of orbital paths for consecutive traversal by said charged particle beam, all said orbital paths having a common linear portion along a common axis, and each said orbital path comprising curved portions and displaced therefrom, each said orbital path being distinguished by the energy of the beam traversing said orbital path, the radii of curvature of curved portions being greater for a greater beam energy whereby said antiparallel portions of said successive orbital paths are displaced at successively greater distances from said common axis; and means for extracting said beam from a selected orbital path comprising first means for diverting said beam from said selected orbital path through a first angle generally toward said common axis and second means for diverting said beam generally toward said common axis, said second means disposed on the opposite side of said axis from said first means and said second means disposed to cause said beam to execute said second diversion through a second angle generally toward said common axis, the magnitude of said first angle equal to the magnitude of said second angle, and envelope means for enclosure of said orbital paths, said envelope means adapted for evacuation.

2. The apparatus of claim 1 wherein said linear accelerator means comprises:

charged particle injection means, a microwave power source for increasing the energy of said charged particle beam, and acceleration cavities for coupling said microwave power to said beam.

3. The apparatus of claim 1 wherein said beam recirculation means comprises first magnetic recirculation means for deflecting said accelerated beam into an orbit portion comprising a path anti-parallel to said acceleration axis and displaced from said acceleration axis in proportion to the energy of the beam particles in said orbit portion; and second magnetic recirculation means for deflecting each non-extracted orbital portion for injection again into said linear accelerator means.

4. The apparatus of claim 3 wherein said extraction means comprises first magnetic extraction means for first deflecting the selected orbital portion inward by a small angle toward the axis of said linear accelerator means, and wherein said second recirculation means causes said inward deflected portion to intersect the axis of said linear accelerator and become extracted, and second magnetic extraction means disposed on the opposite side of said acceleration axis from said first magnetic extraction means for again deflecting inwardly said first deflected beam portion.

5. The apparatus of claim 4 further comprising extracted beam displacement means for causing the extracted beam to occupy a colinear extension of the trajectory of said accelerated beam.

6. The apparatus of claim 4 wherein said first magnetic extraction means comprises a pair of pole piece portions defining a first gap alignable with a selected orbit;

a second pair of pole piece portions defining a second gap displaced away from said common acceleration axis, said pole piece portions on corresponding sides of each said first and second gaps being linked by respective magnetic yoke portions;

mechanical correlating means for maintaining corresponding pole pieces in alignment, magnetic field excitation means for producing a magnetic flux in said first gap for deflecting said selectable orbit portion inward toward said common axis and magnetic field excitation means producing a second magnetic flux in said second gap, said second flux being substantially equal in magnitude to said first flux and antiparallel to said first flux.

7. The apparatus of claim 4 wherein said first magnetic extraction means comprises a pair of pole piece portions defining a gap alignable with a selected orbit, said pole piece portions being linked by magnetic yoke means; magnetic field excitation means for producing a magnetic flux in said gap for deflecting said selectable orbit portion inward toward said acceleration axis.

8. The apparatus of claim 7 wherein said pole piece portions are mounted for movement along a path transverse to said common axis.

9. The apparatus of claim 4 wherein said first magnetic extraction means comprises pole piece portions defining at least three magnetic flux gaps, each such gap aligned with an orbital portion, each said orbital portion corresponding to a different nominal beam energy;

yoke portions forming magnetic flux conduction paths between pole piece portions on corresponding sides of said gaps;

pole piece excitation means whereby magnetic flux across selected gaps may be excited; and magnetic flux inhibition means for inhibiting the magnetic flux through selected said yoke portions.

10. The apparatus of claim 4 wherein said means for causing said inward deflected beam to intersect the linear accelerator axis is said second magnetic recirculation means and wherein said second magnetic recirculation means comprises compensation means for compensating the defocusing of the extracted beam in the plane normal to the orbital plane.

11. The apparatus of claim 10 wherein said compensation means comprises a magnetic quadrupole lens.

12. The apparatus of claim 10 wherein said compensation means comprises means for altering the magnetic field distribution relative to the exit portion of the trajectory of said extracted beam from said second magnetic deflection means.

13. The apparatus of claim 4 wherein said vacuum envelope further comprises orbit defining means to limit the geometric extent of the orbital paths described by said beam and to limit the momentum of said beam.

14. The apparatus of claim 4 further comprising second magnetic extraction means for deflecting said beam again inward toward said linear acceleration axis.

15. The apparatus of claim 14 further comprising beam displacement means for displacing the trajectory of said extracted beam to a colinear extension of said linear acceleration axis.

16. In a racetrack microtron comprising an accelerating portion and beam recirculation means wherein beam particles describe successive orbital paths having successively greater beam energies, said orbital path sharing a common portion and each said orbital path having a portion located at correspondingly successive greater displacement from said common portion, said recirculation means returning beam particles from a given displacement and corresponding energy to again traverse said common portion, the method of extraction of a charged particle beam from a selectable orbit of said racetrack microtron, comprising the steps of:

first deflecting said beam from a selected orbit toward said common portion to then enter said recirculation means, whereby beam particles having the energy characteristic of an orbital path of a given displacement from said common portion enter said recirculation means at a lesser displacement and emerge from said recirculation means at an angle to said common portion whereby said deflected beam is not recirculated, and deflecting again said emerging beam toward said common portion, said latter deflection defined by an angle substantially equal in magnitude to the angle of said first deflection.

* * * * *